US011041699B2

(12) United States Patent
Babcock

(10) Patent No.: US 11,041,699 B2
(45) **Date of Patent: *Jun. 22, 2021**

(54) SYSTEM FOR PORTABLE AND SAFE SHOOTING TARGETS

(71) Applicant: Alex Babcock, Peoria, AZ (US)

(72) Inventor: Alex Babcock, Peoria, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/748,915

(22) Filed: Jan. 22, 2020

(65) Prior Publication Data

US 2020/0158477 A1 May 21, 2020

Related U.S. Application Data

(63) Continuation of application No. 16/027,348, filed on Jul. 4, 2018, now Pat. No. 10,634,464.

(60) Provisional application No. 62/528,751, filed on Jul. 5, 2017.

(51) Int. Cl.
*F41J 1/10* (2006.01)
*F41J 7/04* (2006.01)

(52) U.S. Cl.
CPC .. *F41J 1/10* (2013.01); *F41J 7/04* (2013.01)

(58) Field of Classification Search
CPC ..... F41J 1/00; F41J 1/10; F41J 7/04
See application file for complete search history.

(56) References Cited

U.S. PATENT DOCUMENTS 1,716,054 A 6/1929 Heimann
4,029,318 A 6/1977 Boss
9,282,752 B1 3/2016 Wylie
9,927,214 B2 3/2018 Cote
10,001,350 B2 6/2018 Pearcey
2008/0210831 A1 9/2008 Considine
2015/0330747 A1 11/2015 Ferrell
2015/0330748 A1 11/2015 Anzalone

OTHER PUBLICATIONS

G. L. Huyett Catalog, "Positive Lock Pins", p. 71, (C) 2015 (Year: 2015).*
Drawing, JABs Extreme Steel Targets (Undated), downloaded on or before Jun. 28, 2017.
Photograph, MGM Target (Undated), downloaded on or before Jun. 28, 2017.
Drawing, IPSC Target (Undated), downloaded on or before Jun. 28, 2017.
Specification Sheet, "Hollow Tread Wheel with Polypropylene Spoked Rim," McMaster-Carr Part No. 29635T31 (Jun. 9, 2017).
Specification Sheet, "Aluminum-Handle Push-Button Quick-Release Pin," McMaster-Carr Part No. 90985A319 (Copyright 2012).

(Continued)

*Primary Examiner* — Laura Davison

(74) *Attorney, Agent, or Firm* — Law Offices of Lisa & Lesko, LLC; Justin Lesko, Esq.

(57) ABSTRACT

Systems and methods are disclosed for a shooting target with improved portability and safety over existing devices. The target uses a pin system for storing the legs, which are easily removed and used to form a base. In addition, accessories are described for a shooting target system and method such as a wheel base, side targets, a swinging "dueling target" system, and "popper" side targets.

15 Claims, 10 Drawing Sheets

(56) References Cited

OTHER PUBLICATIONS

Specification Sheet, "18-8 Stainless Steel Wire Rope Lanyard,"McMaster-Carr Part No. 30345T524 (Undated), downloaded on or before Jun. 28, 2017.
Specification Sheet, "18-8 Stainless Steel Wire Rope Lanyard," McMaster-Carr Part No. 30345T521 (Undated), downloaded on or before Jun. 28, 2017.
Specification Sheet, "High-Load Oil-Embedded Thrust Bearing," McMaster-Carr Part No. 2879T3 (Copyright 2015).
Specification Sheet, "Thin Nylon-Insert Locknut," McMaster-Carr Part No. 94945A218 (Copyright 2015).
"Aluminum Pro Mechanic Bike Repair Stand Foldable Bicycle Workstand Lightweight & Portable," (Undated), downloaded from https://www.roadbikeoutlet.com/conquer-portable-aluminum-mechanic-bike-repair-stand-bicycle-workstand.html?utm_source=vilano&utm_campaign=buynow on Jul. 23, 2018.
"Dueling Tree," (captured Apr. 11, 2014), downloaded from http://steelplinkers.com/DuelingTree.html on May 2, 2019.
Filed Jul. 5, 2017, U.S. Appl. No. 62/528,751, Provisional Utility.
Filed Jul. 4, 2018, U.S. Appl. No. 16/027,348, Non-Provisional Utility.
U.S. Pat. No. 4,029,318—Boss, Jun. 1977, U.S. Appl. No. 16/027,348.
U.S. Pat. No. 1,716,054—Heimann, Jun. 1929, U.S. Appl. No. 16/027,348.
U.S. Pub. No. 2015/0330747—Ferrell, Nov. 2015, U.S. Appl. No. 16/027,348.

* cited by examiner

SYSTEM FOR PORTABLE AND SAFE SHOOTING TARGETS

CROSS REFERENCE TO RELATED APPLICATIONS

This application is a continuation of application Ser. No. 16/027,348, Filed Jul. 4, 2018, which claims priority to Provisional Application No. 62/528,751, Filed Jul. 5, 2017, both of which are herein incorporated by reference.

BACKGROUND OF THE INVENTION

1. Field of the Invention

This application relates to and describes a shooting target with improved portability and safety over existing devices. In addition, improved devices and accessories relating to shooting targets are described such as hinges, pins, trailer hitch mounts, dueling target mounts, wheel assemblies, and poppers, among others.

2. Description of Related Art

Existing Targets. Existing shooting targets from JABs, Extreme, and MGM targets, among others, are provided herewith and cited on an Information Disclosure Statement. The existing targets suffer from multiple shortcomings, as explained below. In short, no existing target is easily portable while maintaining safety, sturdiness, reliability, and longevity. Unlike existing targets, Applicant's invention provides a system that is compacted during transportation, yet easy to set up with a safe deflection angle, even when constructed from heavy, high-quality steel parts.

More specifically, the legs, stand and upright posts of the invention are designed such that they can be made from high grade AR-550 Abrasion Resistant Steel that will withstand the impact of misplaced bullets. Existing targets use low grade angle iron and tubing, which is susceptible to damage and unpredictable bullet direction.

The invention has a minimum 15 degree angle that is adjustable to 20 degrees. This provides downward direction to the projectile and a more predictable bullet deflection. Existing targets do not have a built-in safety angle for the impact zone.

Existing targets do not have a way to pin and transport pieces together. The base in existing targets is often sharp and awkward to transport. The invention allows for pieces to be pinned together for transport, and then set up.

Existing targets secure the target silhouette with bolts or hardware that can be impacted by a projectile, damaged, and also send the bullet in an unpredictable direction.

Applicant's invention can be used with existing target pieces, such as the "industry standard" IPSC torso target, or with suitable custom made target pieces. An exemplary quick pin for use with Applicant's invention is McMaster-Carr Part No. 29635T31, although other quick pins can also be used. McMaster-Carr Part Nos. 30345T524 and 30345T521 are exemplary lanyards that can be used to hold the quick pins.

For the embodiments of the invention that include a hinge, McMaster-Carr Part No. 2879T3 is an exemplary thrust bearing, and McMaster-Carr Part No. 94945A218 is an exemplary locknut. Similarly, McMaster-Carr Part No. 29635T31 is an exemplary wheel for use with certain embodiments of the invention. These are merely examples of hardware suitable for use with the invention.

Applicant(s) believe(s) that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), Applicant(s) will amend the specification to expressly recite the essential material that is incorporated by reference as allowed by the applicable rules.

SUMMARY

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventor is fully aware that he can be his own lexicographer if desired. The inventor expressly elects, as his own lexicographer, to use only the plain and ordinary meaning of terms in the specification and claims unless he clearly states otherwise and then further, expressly sets forth the "special" definition of that term and explains how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of post-AIA 35 U.S.C. § 112(f). Thus, the use of the words "function," "means" or "step" in the Detailed Description or Description of the Drawings or claims is not intended to somehow indicate a desire to invoke the special provisions of post-AIA 35 U.S.C. § 112(f), to define the invention. To the contrary, if the provisions of post-AIA 35 U.S.C. § 112(f) are sought to be invoked to define the inventions, the claims will specifically and expressly state the exact phrases "means for" or "step for," and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventor not to invoke the provisions of post-AIA 35 U.S.C. § 112(f). Moreover, even if the provisions of post-AIA 35 U.S.C. § 112(f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

The aspects, features, and advantages will be apparent to those artisans of ordinary skill in the art from the DETAILED DESCRIPTION and DRAWINGS, and from the CLAIMS. However, without attempting to characterize or limit the scope of inventions as they are described and claimed, some of the advantages of the various inventions are summarized below.

The shooting targets and related accessories and inventions described herein are designed with improvements in at least four areas: Shooter safety, Quality, Versatility, and Portability.

Existing targets are often in fixed positions with permanently attached bases, making them difficult to transport, move around, set up, and/or accessorize. Furthermore, existing targets often do not always account for safe, predictable bullet deflection with a variety of calibers and projectile velocities.

It is an object of the invention to provide a shooting target that is easier to transport and set up by using a pin system and hinged legs that attach to the main target base in one position for transportation and another position for shooting.

It is yet another (and optionally independent) object of the invention to provide a shooting target that maintains a safe 15 to 20-degree projectile deflection angle toward the ground while maintaining portability and durability.

It is yet another (and optionally independent) object of the invention to provide a shooting target with an adjustable projectile deflection angle by using hinged legs with a fixed base.

It is yet another (and optionally independent) object of the invention to provide a shooting target that predictably and safely deflects projectiles along a well-defined path below the target.

It is yet another (and optionally independent) object of the invention to provide a shooting target that attaches the target silhouette without bolts or other hardware that can be impacted by a projectile or damaged, or that send or deflect the bullet in an unpredictable direction.

It is yet another (and optionally independent) object of the invention to provide an accessory attachment for side targets that is easy to attach/remove. In one form, the accessory attachment fits over the back rail of the main target and includes a threaded section with a bolt for securing the piece to the main target rail.

It is yet another (and optionally independent) object of the invention to provide an easy to attach/remove wheel attachment for transporting the target and other attachments. In one form, the wheel attachment is secured to the main target, and includes a threaded section with a bolt for securing the piece to the main target rail.

It is yet another (and optionally independent) object of the invention to provide an improved accessory attachment having slots for securing yet other attachments, wherein the accessory attachment optionally includes square tubing for mounting to a trailer hitch for ease of transportation.

It is yet another (and optionally independent) object of the invention to provide an improved target that enables the angle of the target relative to the ground to be easily adjusted.

It is yet another (and optionally independent) object of the invention to provide an improved target system that can be easily scaled to many different silhouette shapes and sizes.

It is yet another (and optionally independent) object of the invention to provide an easy to attach/remove "dueling target" attachment that includes a rotating side target. The "dueling target" attachment secures to the main target, includes a threaded section with a bolt for securing the piece to the main target rail.

It is yet another (and optionally independent) object of the invention to reduce the weight of the parts while still constructing them from heavy, high-quality steel. In one form, the legs include slots to reduce their overall weight. The slots may also function as hand grips for the user when picking up, folding, or adjusting the legs. Similar slots can optionally be included in other attachments or parts of the target system.

It is yet another (and optionally independent) object of the invention to provide side "popper" attachments as additional targets that are easy to attach, remove, and transport.

In one form of the invention, a shooting target is provided that includes a post having a plurality of spaced-apart pinholes on a plane of the post. The holes can be of like size, although they may also be different sizes. A target plate (of any desired shape) is coupled with or secured to a top portion of the post. A bottom plate is coupled with or secured to a bottom portion of the post, and includes two slots. The slots can be located at approximately symmetrical positions relative to the vertical center line of the front of the post or at another position suitable for inserting the legs. In one form, the slots are rectangular, although they can be circular or take other shapes, which may depend on the shape of the legs. A first leg is coupled to a second leg using, for example, a hinge assembly. The first and second legs each include pinholes to assist in securely transporting and storing the target. The first leg is configured to fold over the second leg via the hinge assembly such that at least two pinholes on the first leg are aligned with two corresponding pinholes on the second leg. In this manner, the pinholes on the legs are alignable with two corresponding pinholes on the post for securing the folded legs to the post with pins. The first and second legs are configured to be unfolded at the hinge to form an angle and to be slidably inserted into the slots of the bottom plate to form a base for the shooting target. In addition, the legs are adjustable (by sliding into different positions) to allow the user to set a desired deflection angle for the target plate (for example, between 15 and 20 degrees from perpendicular when the target is placed on level ground). Other deflection angle ranges are also possible, depending on the application.

In one form of the invention, the pins may be any of the widely available "quick-pins" or "quick-release pins". Quick release pins are available in many forms, such as detent pins, or non-threaded cylindrical fasteners that are inserted into one or more holes to fix a component's position, join components, or maintain alignment between them in assemblies that require frequent adjustment. Alternatively, threaded pins can be used.

In one form of the invention, the hinge assembly may comprise a male connector welded to the first leg, and a female connector welded to the second leg. A washer (preferably a thrust washer) is placed between the male connector and female connector. A nut (preferably a lock nut) is screwed onto the top of the male connector to secure the female connector. Other suitable hinges may also be used.

In one form of the invention, the post, target plate, bottom plate, and first and second legs comprise a hardened steel. Preferably the hardened steel has a Brinell hardness rating of at least 500 steel.

In one form of the invention, the bottom plate is welded to the post. In another form of the invention, the bottom plate may be secured by heavy duty fasteners. In yet another form, rather than welding the bottom plate to the post, the post itself is machined to include a shape at its bottom plate similar to the bottom plate, such that no separate bottom plate is necessary. In another form, rather than attaching/securing a bottom plate and target plate to a post, a single main body piece includes a post portion, a bottom plate portion, and a main target portion.

In one form of the invention, one or more slots are formed in the first and second legs that can be used to grip the legs. For example, the slots can be large enough for human fingers and/or knuckles to fit through (or larger).

In one form of the invention, the shooting target further includes an accessory rail welded to the post. The accessory rail allows accessories such as additional side targets, swinging "dueling" targets that swivel from one side to another, and a wheel attachment to be attached to the shooting target. With the accessory rail, the accessories typically include slots that fit over the rail and bolts to secure the accessories tightly, such that the accessories can be attached or detached as needed using the bolts. Alternatively, the accessories can be welded to the accessory rail or secured with other heavy duty fasteners.

In one form of the invention, the shooting target further includes a swinging "dueling" target attachment The dueling target may take any of a plurality of desired shapes or forms. The dueling target is configured to be secured to the accessory rail. In a preferred form the dueling target comprises a circular target that is mounted so that it swings. The mounting can be accomplished, for example, with an attachment piece including a slot that fits over the accessory rail and a bolt hole for securing the side target attachment. A threaded rod is secured to the attachment piece and also coupled with a swinging piece that has the circular side target such that, when the side target attachment is attached to the accessory rail, the swinging piece rotates on the threaded rod and "swings" from one side of the post to another when the circular target is hit with a projectile.

In one form of the invention, side targets are welded or otherwise "fixed" to an attachment piece that can be bolted or secured to the accessory rail. For example, a left circular side target and a right circular side target can be included on the same attachment piece, and when that attachment piece is secured to the accessory rail for shooting, the targets do not rotate when hit with a projectile.

In one form of the invention, one or more side "popper" target attachments are configured to be secured to the base plate (rather than an accessory rail). The side popper has a side popper post including a top notch for securing a side target (which can be circular or any other form) and a bottom notch for securing the side popper post to the base plate. The base plate in this form of the invention can also have notches to assist with fitting the side popper post to the baseplate.

In one form of the invention, the shooting target has a deflection angle that is adjustable within a defined range to safely deflect projectiles while maintaining stability. The shooting target includes main target assembly with slots configured to slidably receive legs. In addition, the shooting target of this form includes a hinged leg assembly comprising a first and second leg coupled via an adjustable hinge. The leg assembly can be inserted into the slots of the main target assembly and adjusted to form a base that creates a deflection angle for the main target assembly that is within a defined range when the shooting target is placed on level ground. The defined range for the deflection angle can be between 15 and 20 degrees from perpendicular, or another defined range is possible, depending on the application.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

In FIG. 1, the legs are inserted into the base plate to form a base.

Elements and acts in the figures are illustrated for simplicity and have not necessarily been rendered according to any particular sequence or embodiment.

DETAILED DESCRIPTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

Figure 1:
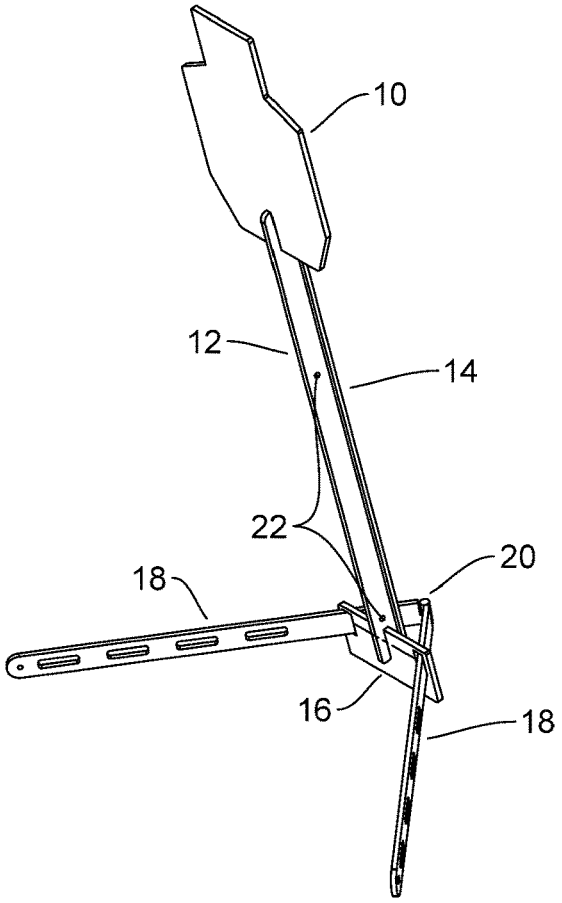
FIG. 1 depicts an isometric view of a first embodiment of the invention, in which a base plate and target plate are secured to the main upright post, and the main upright post is secured to an accessory rail attachment.
Figure 2:
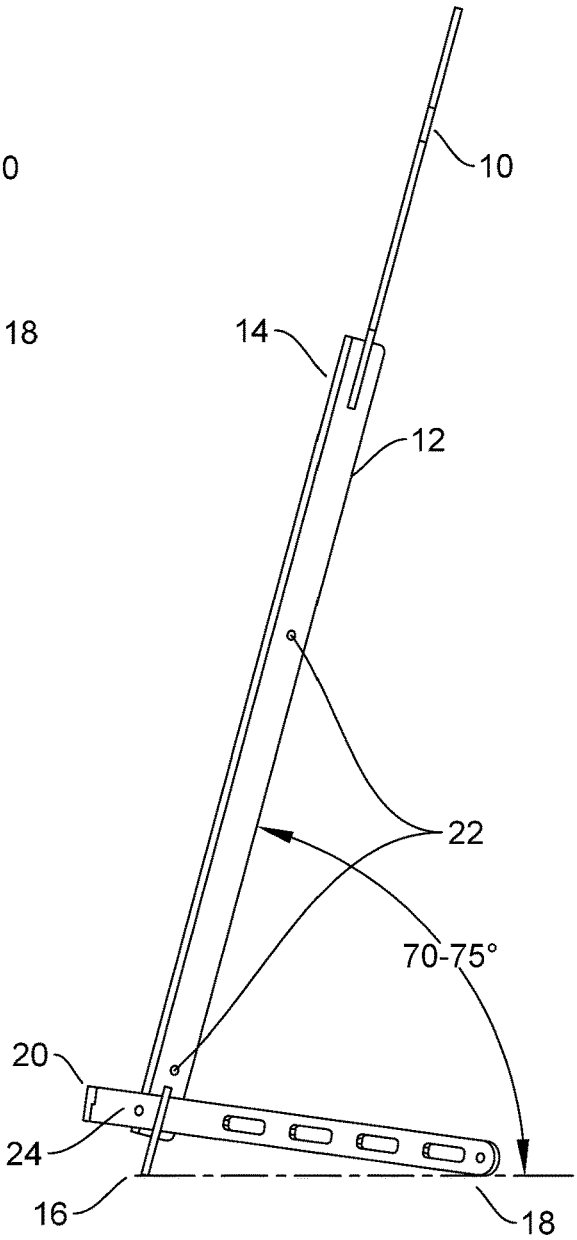
FIG. 2 depicts a side view of the first embodiment.
Figure 3:
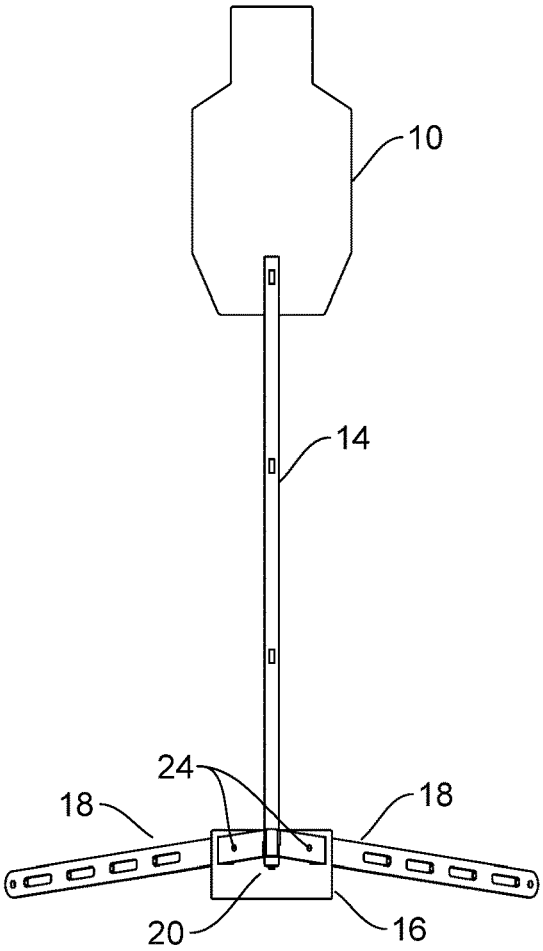
FIG. 3 depicts a back view of the first embodiment.

FIGS. 1, 2, and 3 depict and describe one embodiment of the present invention. As shown, the invention includes a main upright post (part 12) with quick pin holes (22) that is secured (for example, welded) to the accessory rail attachment part 14. The base plate (part 16) is secured (for example welded) to the bottom of part 12, and the main torso silhouette (part 10) connects and/or welds to the top of part 12.

Figure 4:
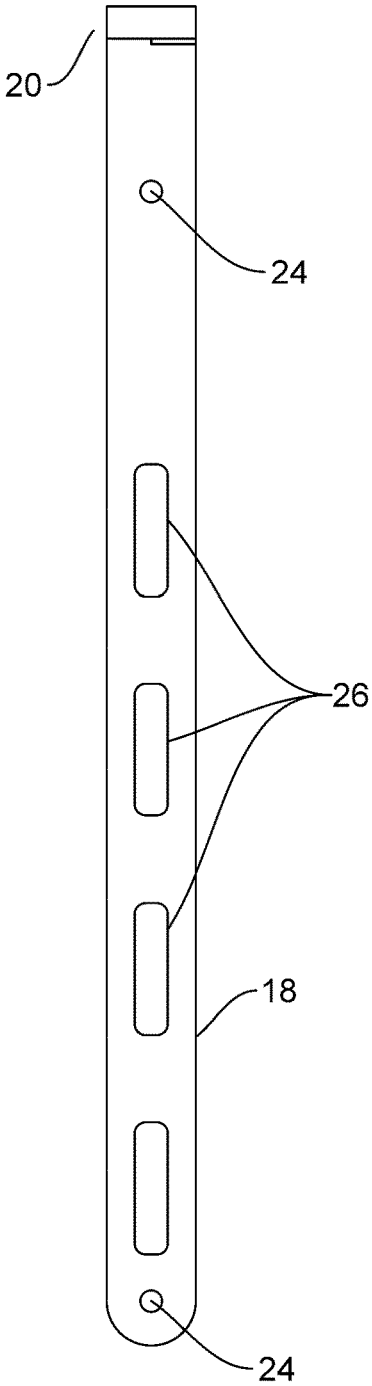
FIG. 4 depicts the legs in the folded position.
Figure 5:
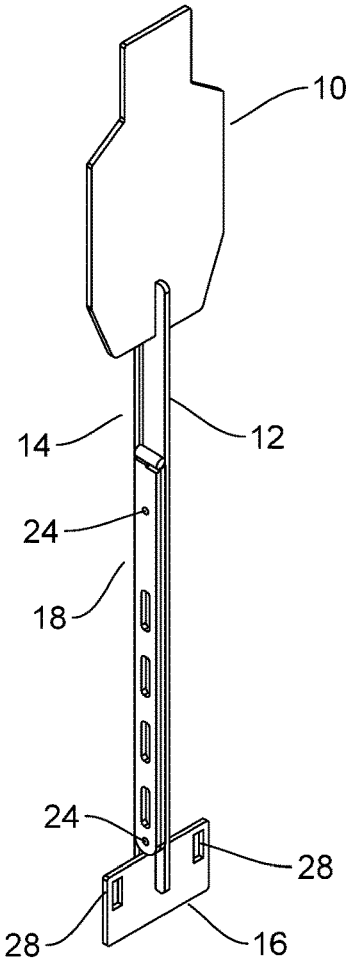
FIG. 5, depicts the first embodiment with the folded legs in position to be pinned to the main upright post.
Figure 6:
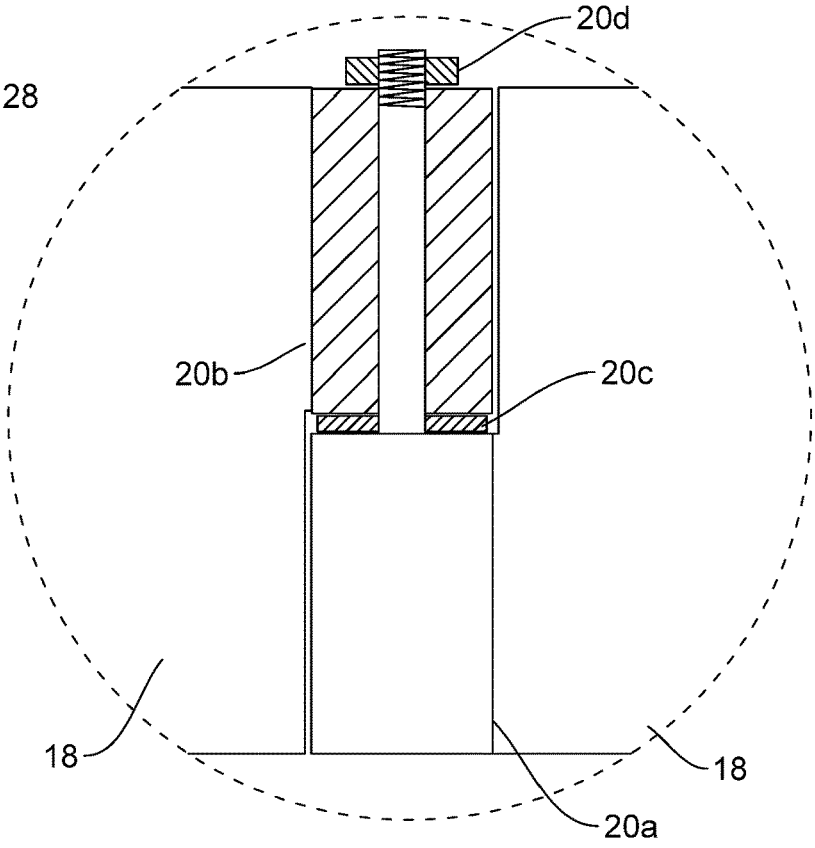
FIG. 6 depicts a close-up view of the hinge assembly for the legs, as assembled.
Figure 7:
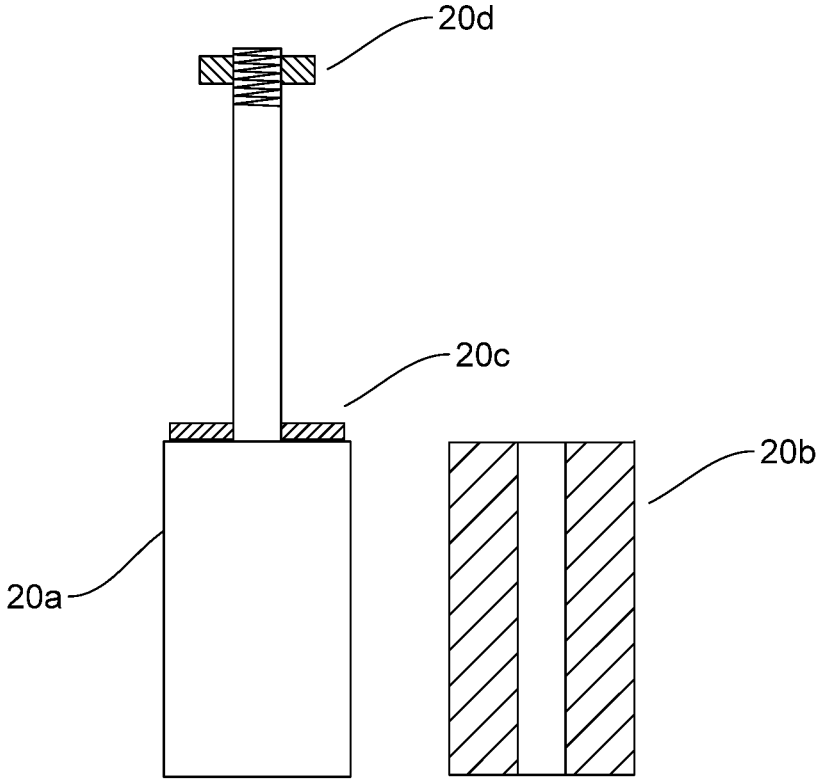
FIG. 7 depicts a detailed view of the parts comprising the hinge assembly, detached from the legs.

The legs (two parts 18) are used to form a hinge assembly (20)—one part 18 is welded to part 20*a* (male connector) and the other part 18 is welded to part 20*b* (female connector), as shown in FIGS. 6 and 7. Using a thrust washer (20*c*) and lock nut (20*d*), the hinge assembly for the legs is formed. With this hinge arrangement for the legs, the legs can be folded over each other as shown FIG. 4, and also attached with pins through holes 24 on the legs and holes 22 on the main upright post, as shown in FIG. 5. This pinned arrangement is useful, for example, when transporting the target from one location to another. In addition, the hinged legs can be opened to form an angle, and inserted into slots (28) of the base plate (part 16) to form the base for the shooting target, as shown in FIGS. 1, 2, and 3.

As shown, with this system and method, the legs are easily attached to the main upright post for transportation of the full assembly, yet they quickly form the base of the target for shooting with the desirable (and adjustable) 15-20 degree (from 90) deflection angle toward the ground. With this angle, unsafe deflections of projectiles shot at the target are minimized.

Figure 8:
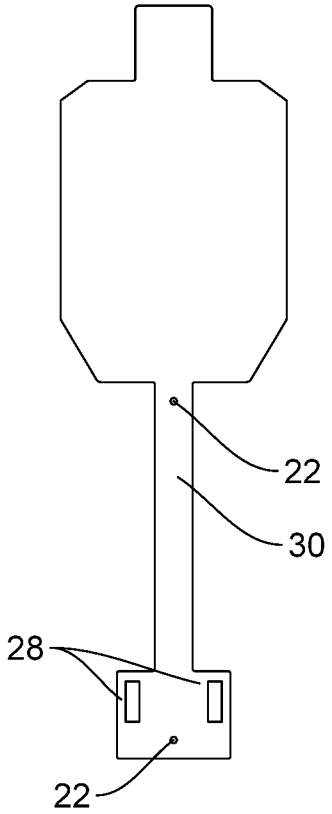
FIG. 8 depicts an isometric view of a second embodiment of the invention, in which the main upright post with quick pin holes, torso target, and base are machined from a single piece.

FIG. 8 shows an alternate embodiment of the invention in which the main upright post with quick pin holes, torso target, and base is machined from a single piece (part 30). Similar to the embodiment above, the legs are hinged as shown in FIGS. 4, 6, and 7, and can either be folded up and attached to the main upright post, or opened to form an angle (which can be adjusted) and inserted into the slots of the base plate to form the base for the shooting target.

Lanyards, such as McMaster-Carr Part Nos. 30345T524 and 30345T521, can be used, for example, to store the quick pins used for the main assemblies, either when the target is placed in the position for shooting or at other appropriate times.

Figure 9:
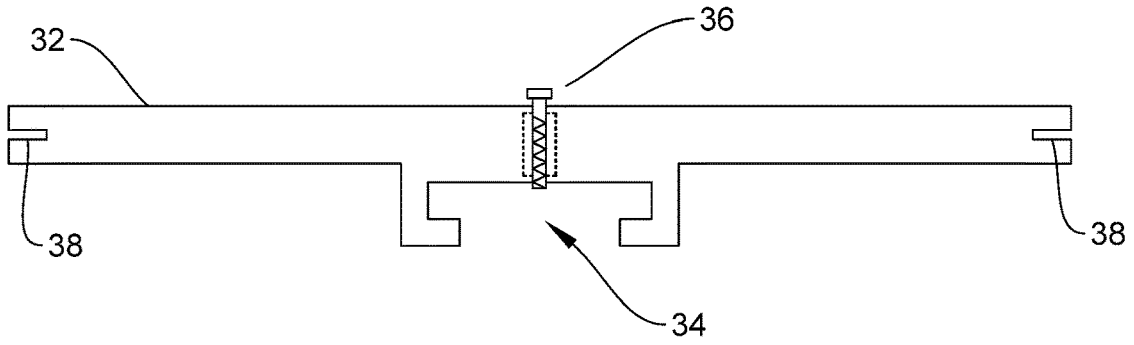
FIG. 9 is a top view of an side target attachment.
Figure 10:
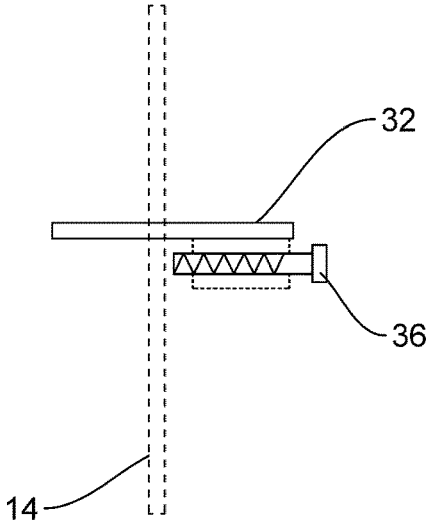
FIG. 10 is a side view of a side target attachment, attached to the accessory rail.
Figure 11:
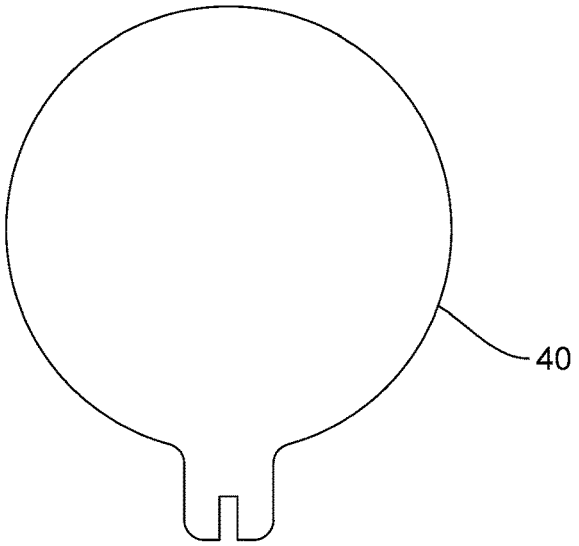
FIG. 11 depicts a side target.
Figure 12:
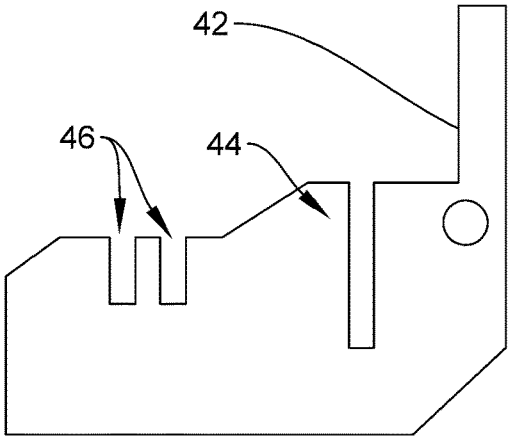
FIG. 12 is a top view of the main part of the wheel attachment.
Figure 13:
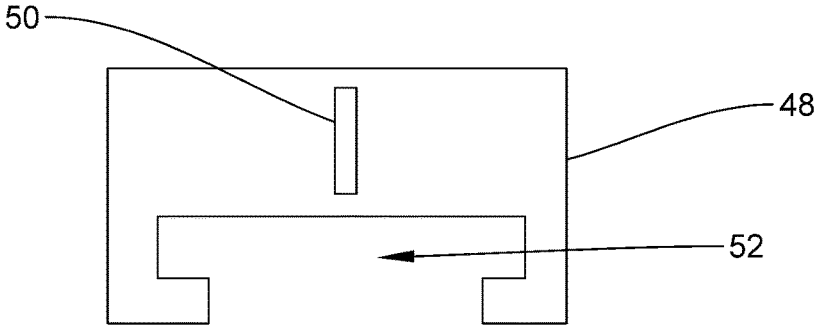
FIG. 13 is a top view of the c-shaped part of the wheel attachment.

FIGS. 9 and 10 depict an accessory rail attachment 32 for attaching side targets. The side target attachment includes a slot (34) for fitting over the accessory rail of the main target assembly (14), and a bolt (36) secures the side target attachment to the accessory rail. The side targets (40) are optionally welded to the side target attachment at the slots (38). FIG. 11 shows an example of a side target 40 that can be used with this aspect of the invention, although many other suitable side targets exist.

Generally, the side target attachment is installed below the main torso silhouette (part 10), although it can also be installed when no main torso silhouette is attached. The side target attachment can be kept in a fixed position or moveable. In addition, a number of these units may be installed at the same time, in different positions on the accessory rail (14). The side targets themselves can come in a variety of shapes and sizes, depending on the needs of the shooter. For example, the side target can be a circular shape that is smaller than the main torso silhouette to give the shooter a smaller point of impact when working on accuracy.

Figure 14:
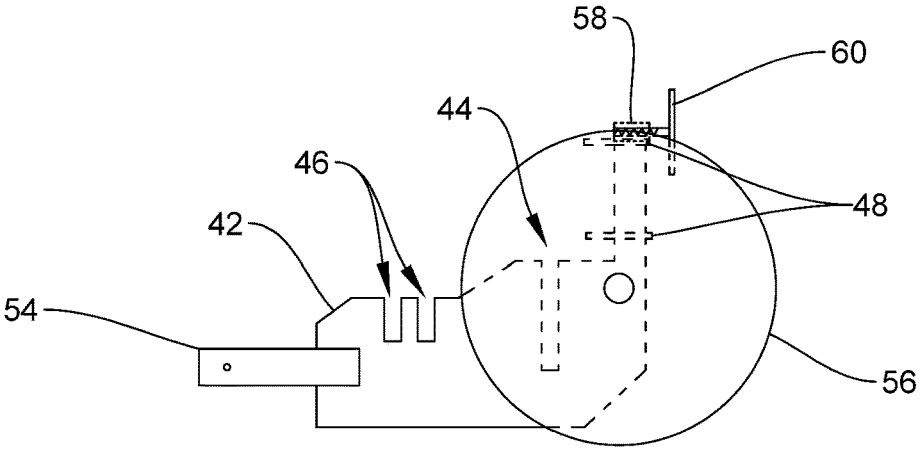
FIG. 14 is a side view of the assembled wheel attachment.
Figure 15:
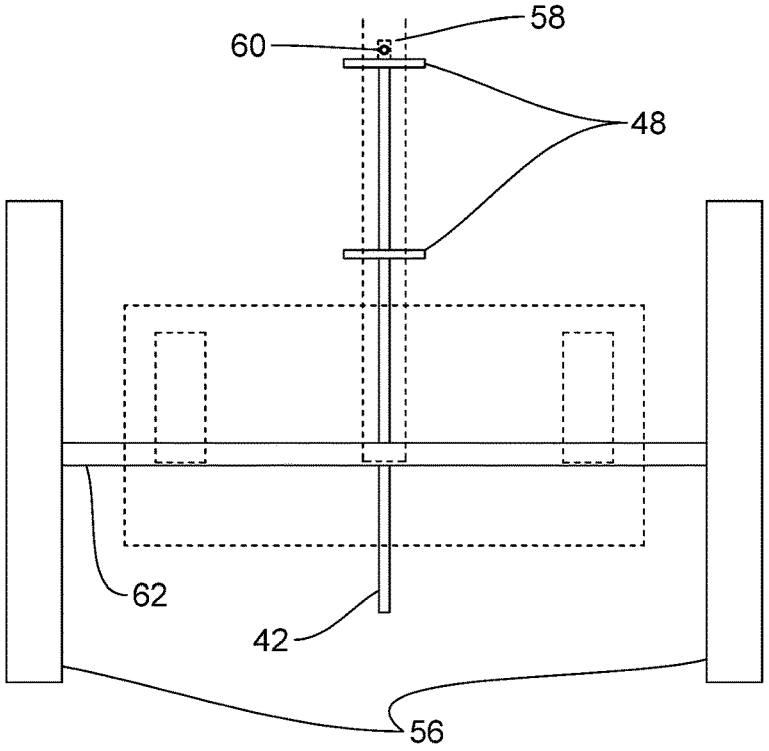
FIG. 15 is a back view of the assembled wheel attachment.
Figure 16:
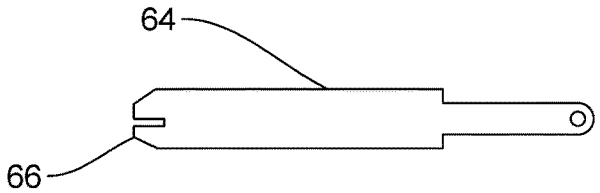
FIG. 16 is part of the swinging "dueling target" attachment.
Figure 17:
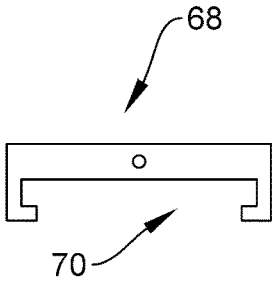
FIG. 17 is a part of the swinging "dueling" target" attachment for connecting it to the accessory rail of the main target assembly.
Figure 18:
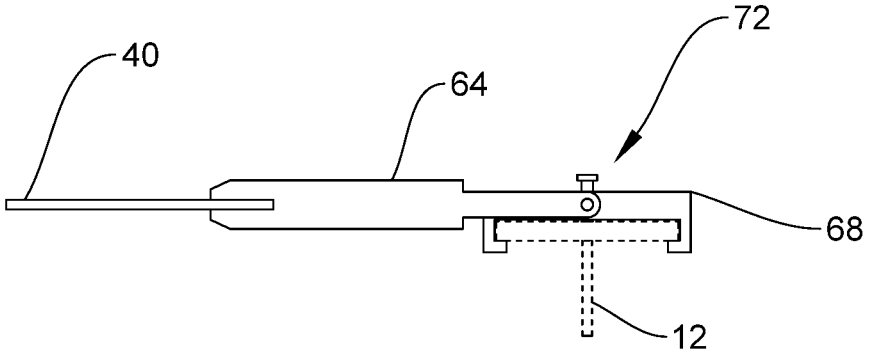
FIG. 18 is a top view of the assembled dueling target.
Figure 19:
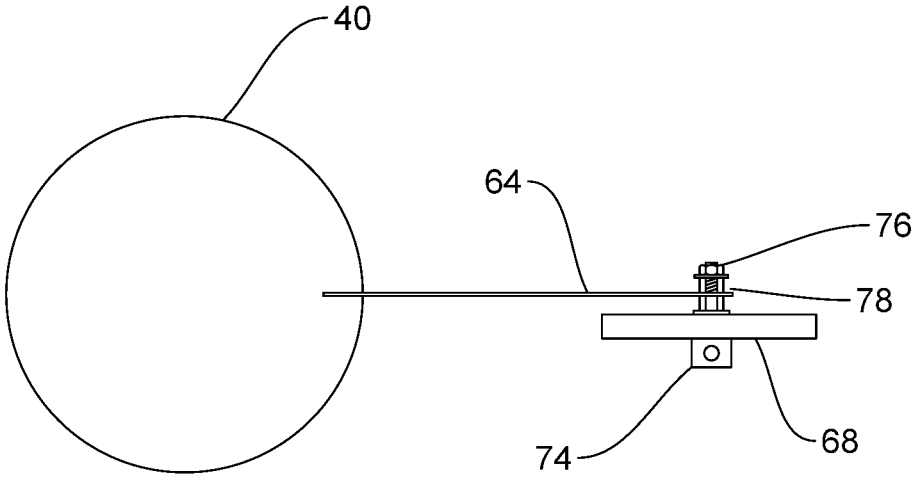
FIG. 19 is a back view of the assembled dueling target.

FIGS. 12-15 depict a wheel attachment (42) to assist with transporting the target and related attachments. The wheel attachment includes receiving brackets (48) with slots (50). The receiving brackets (48) are attached to wheel attachment (42) as shown in FIG. 14. The accessory rail attachment (14) slides into the C shaped slots (52) of receiving brackets (48). The wheel attachment also includes another slot (44) for securing the base plate (part 16) of the main target assembly. Optionally included are additional slots (46) for storing accessories, and a piece of tubing (54) for securing the wheel attachment to a standard trailer hitch. The wheel (56) and axle (62) can be any suitable wheel/axle, and may depend on the specific application or terrain. An example wheel for use with this attachment is McMaster-Carr Part No. 29635T31. The wheel attachment can also included a threaded portion (58) for use with a bolt (60) to secure the attachment to the main assembly.

FIGS. 15-19 depict a swinging "dueling target" attachment. The dueling target attachment includes a threaded rod (76) and bushing (78) that allows for the target to "swing" from side to side when attached to the accessory rail (14). The dueling target includes a c shaped slot (68) and block (74) for receiving a bolt (72) for attachment to the accessory rail of the main target assembly. The side target (40) is optionally welded to the dueling target attachment at the slot (66) of the swinging arm (64). FIG. 11 shows an example of a side target that can be used with this aspect of the invention, although many other suitable side targets exist.

Generally, the dueling target attachment is installed below the main torso silhouette (part 10), although it can also be installed when no main torso silhouette is attached. In addition, a number of these units may be installed at the same time, in different positions on the accessory rail (14). The side targets themselves can come in a variety of shapes and sizes, depending on the needs of the shooter. For example, the side target can be a circular shape that is smaller than the main torso silhouette to give the shooter a smaller point of impact when working on accuracy.

Figure 20:
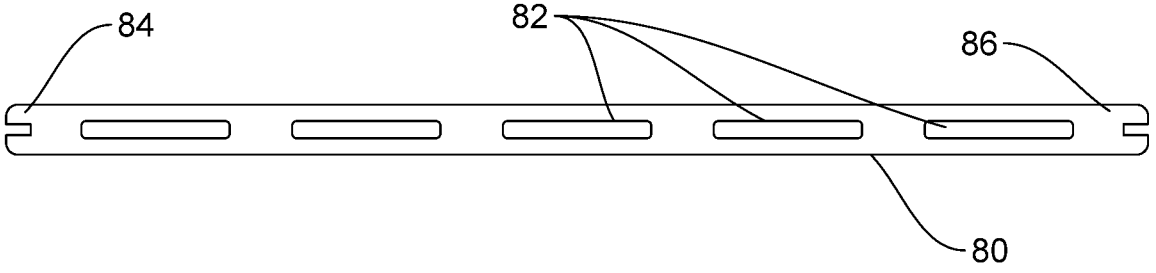
FIG. 20 depicts the upright post of the side "popper" attachment.
Figure 21:
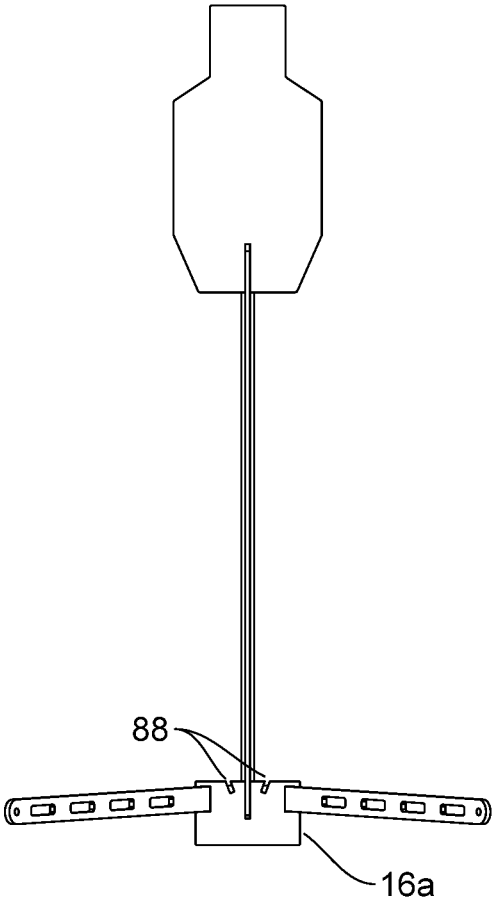
FIG. 21 depicts the main assembly with a modified baseplate for the popper attachment.
Figure 22:
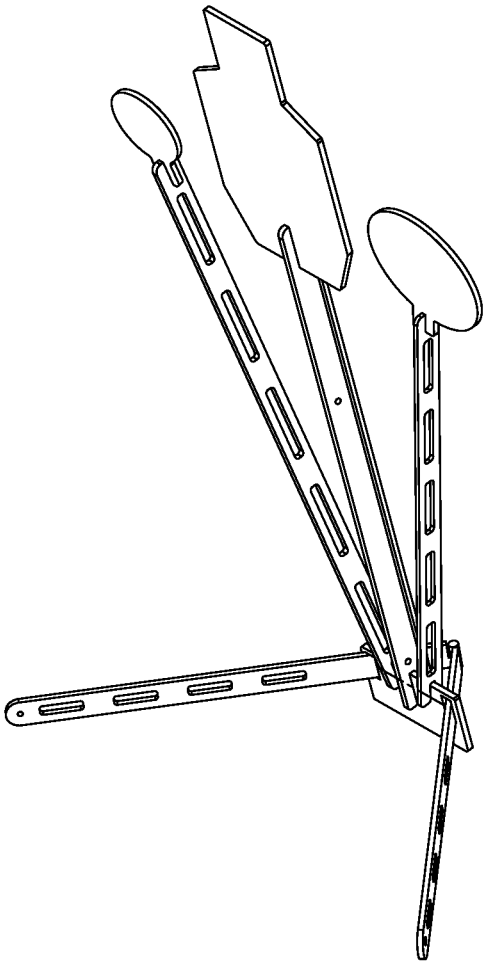
FIG. 22 depicts an isometric view of two side popper attachments secured to the main assembly at the base plate, including side targets.

FIGS. 20-23 depict side "popper" attachments. Each side "popper" provides an additional target for the shooter (typically smaller than the main target silhouette, although not required to be) that is attached to the same base, so that the shooter can easily set up multiple targets to practice aiming at different targets and moving from one target to the next. FIG. 20 shows the upright post (80) for a side popper. In one embodiment of this aspect of the invention, the upright post includes a bottom notch 84 for securing the post to the base plate, and a top notch 86 for securing a side target to the post. As shown in FIG. 21, the base plate 16*a* of the main assembly in this embodiment includes one or more notches (88) for securing the side popper attachments for shooting. FIG. 22 depicts an isometric view of two side popper attachments secured to the main assembly at the base plate, including side targets. FIG. 11 shows an example of a side target that can be used with this aspect of the invention and attached to the top notch of the side popper upright post (80), although many other suitable side targets exist.

Figure 23:
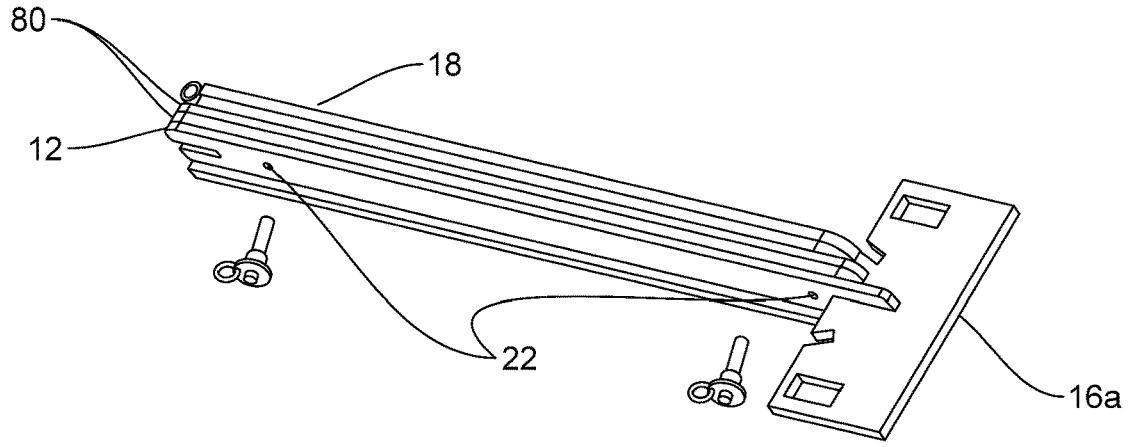
FIG. 23 depicts the popper and legs pinned to the main assembly.

The side popper attachment can also include quick pin holes, similar to the quick pin holes of the legs (18). The quick pin holes of the side popper or poppers can be placed on the side popper post (80) to line up with the holes 24 on the legs (18) and holes 22 on the main upright post (12) so that these parts can be pinned together, as shown in FIG. 23 (including two side poppers, 18). This pinned arrangement is useful, for example, when transporting the target and poppers from one location to another.

The notches (88) in base plate 16*a* can also be used to different variations of the side poppers or other attachments.

For many of the parts listed above, slots can be machined into the parts to reduce their weight. In one form, the legs include such slots (26), as shown in FIGS. 1-5. The slots (26) may also be sized and placed to act as hand grips for the user when picking up, folding, or adjusting the legs. Similar slots can optionally be included in other attachments or parts of the target system. For example, in one embodiment, the popper attachments include such slots (82), as shown in FIGS. 20 and 22.

Figure 24:
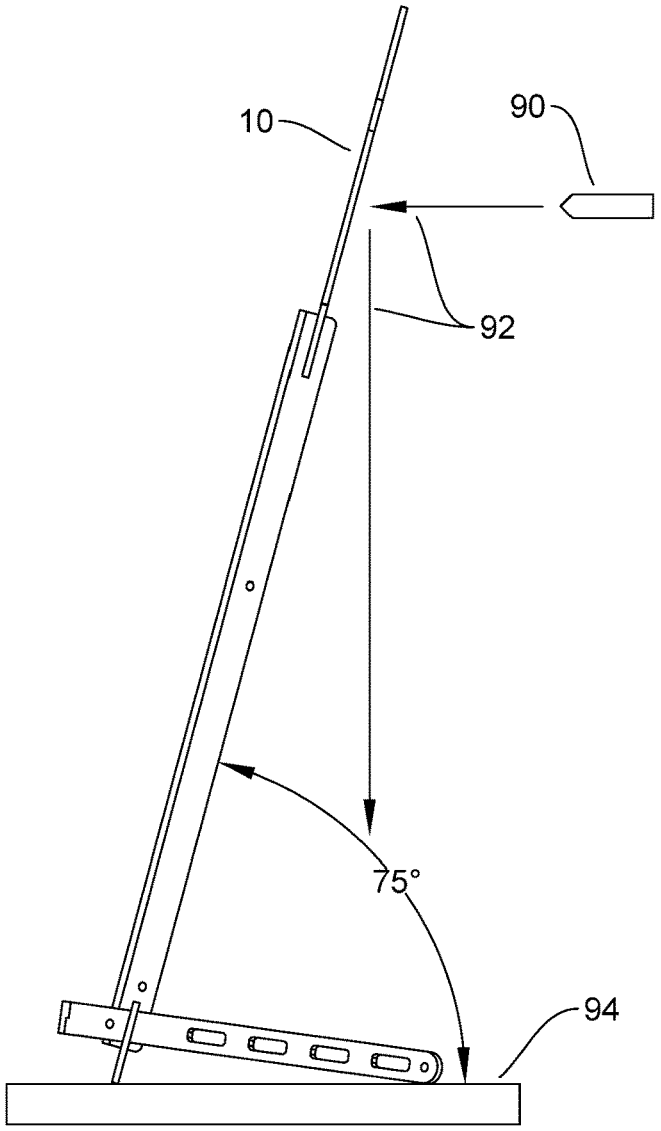
FIG. 24 illustrates how a projectile might be deflected after hitting the target set at a deflection angle of 15 degrees from perpendicular (75 degrees relative to the ground) on level ground.

FIG. 24 illustrates how a projectile is deflected after hitting the target set at a deflection angle of 15 degrees from perpendicular (75 degrees relative to the ground) on level ground. A projectile 90 (such as a bullet) is shot at the target and impacts the target plate 10. The path of the projectile is represented by the arrows 92. As shown, after impacting the target plate, the projectile is deflected toward the ground 94 close to the base of the target. While the exact path of a given projectile varies, FIG. 24 is illustrative of the projectile path.

The embodiments described above can be manufactured, for example, from AR500 and/or AR550 steel (AR meaning "Abrasion Resistant," and 500 and 550 representing Brinell scale hardness), which is used for military and industrial applications, or from other suitable materials.

What is claimed is:

1. A shooting target comprising:

a) a main body including:

a. a post portion with two pinholes located on the post portion;

b. a target portion;

c. a bottom portion that includes two slots located at approximately symmetrical positions relative to a vertical center line of a front surface of the post portion;

b) a first leg coupled to a second leg via a hinge assembly, wherein:

a. the first and second legs each include pinholes;

b. the first leg is configured to be folded onto the second leg via the hinge assembly such that at least two pinholes on the first leg are relatively aligned with at least two pinholes on the second leg, and the aligned pinholes on the first and second legs are alignable with the two pinholes on the post portion for securing the folded legs to the post portion with pins;

c. the first and second legs are configured to be unfolded at the hinge to form an angle and to be slidably inserted into the slots of the bottom portion to form a base for the shooting target; and d. wherein a deflection angle for the target portion is adjustable by sliding the unfolded legs into different positions in the slots of the bottom portion.

2. The shooting target of claim 1, wherein the deflection angle for the shooting target is adjustable between 15 and 20 degrees from perpendicular when the shooting target is placed on level ground.

3. The shooting target of claim 1, wherein the hinge assembly comprises:

a) a male connector welded to the first leg;

b) a female connector welded to the second leg;

c) a thrust washer placed between the male connector and female connector; and d) a lock nut screwed onto a portion of the male connector to secure the female connector.

4. The shooting target of claim 1, wherein the main body and first and second legs comprise AR-500 or AR-550 steel.

5. The shooting target of claim 1, wherein each leg includes at least one hand grip slot.

6. The shooting target of claim 1, further comprising a side target attachment configured to be secured to the main body, the side target attachment comprising:

a) an attachment piece including a slot that fits over the main body and a bolt hole for securing the side target attachment to the main body;

b) a circular target attached to a swinging piece;

c) a threaded rod secured to the attachment piece and also configured to be coupled with the swinging piece such that, when the side target attachment is attached to the main body, the swinging piece rotates on the threaded rod and swings from one side of the main body to another when the circular target is hit with a projectile.

7. The shooting target of claim 1, further comprising a side target attachment configured to be secured to the main body, the side target attachment comprising:

a) an attachment piece including a slot that fits over the main body and a bolt hole for securing the side target attachment to the main body;

b) a right side target welded to a first side of the attachment piece; and c) a left side target welded to a second side of the attachment piece, opposite the first side.

8. The shooting target of claim 1, further comprising a side popper configured to be secured to the main body, the side popper comprising a side popper post including a top notch for securing a side target and a bottom portion for securing the side popper post to the bottom portion of the main body.

9. A shooting target, comprising:

a) a main target assembly that includes (1) two slots for slidably receiving legs and (2) a post portion with two holes;

b) a leg assembly comprising a first leg coupled to a second leg via a hinge assembly, wherein (1) the first leg is configured to be folded onto the second leg via the hinge assembly such that two holes on the first leg are relatively aligned with two holes on the second leg, and the aligned holes on the first and second legs are alignable with the two holes on the main target assembly for fastening the folded legs to the main target assembly; and (2) the first and second legs are configured to be unfolded at the hinge assembly to form an angle and to be slidably inserted into the two slots to form an adjustable base for the shooting target that adjusts a deflection angle of the shooting target.

10. The shooting target of claim 9, wherein the adjustable base adjusts the deflection angle to between 15 and 20 degrees from vertical.

11. The shooting target of claim 9, wherein the folded legs are fastened to the main target assembly with pins.

12. The shooting target of claim 11, wherein the pins are quick-release pins.

13. The shooting target of claim 11, wherein the pins are threaded pins.

14. The shooting target of claim 9, further comprising an accessory attachment that includes two holes that are alignable with the two holes on the main target assembly for fastening the accessory attachment to the main target assembly during transportation and a separate fastener portion for fastening the accessory attachment to the main target assembly during shooting.

15. A method of transporting a shooting target that includes (a) a main target assembly and (b) a leg assembly comprising a first leg coupled to a second leg via a hinge assembly, the method comprising:

(1) folding the first leg onto the second leg via the hinge assembly such that two holes on the first leg are relatively aligned with two holes on the second leg;

(2) aligning the aligned holes on the first and second legs with two holes on the main target assembly;

(3) fastening the folded legs to the main target assembly via pins through the aligned holes on the first and second legs and the main target assembly;

(5) unfastening the folded legs from the main target assembly by removing the pins;

(6) unfolding the hinge assembly to form an angle between the first and second legs; and (7) slidably inserting the first and second legs into two slots of the main target assembly to form an adjustable base for the shooting target and adjust the deflection angle of the shooting target.

* * * * *